United States Patent [19]

Krusche

[11] Patent Number: 4,610,694

[45] Date of Patent: Sep. 9, 1986

[54] MATCH

[76] Inventor: Kurt Krusche, Nansenring 22, 6000 Frankfurt/Main, Fed. Rep. of Germany

[21] Appl. No.: 768,145

[22] Filed: Aug. 22, 1985

[30] Foreign Application Priority Data

Nov. 15, 1984 [DE] Fed. Rep. of Germany ..... 3441773

[51] Int. Cl.[4] ..... C06F 3/00; C06F 5/00

[52] U.S. Cl. ..... 44/42; 44/47

[58] Field of Search ..... 44/42, 46, 47

[56] References Cited

U.S. PATENT DOCUMENTS 592,227 10/1897 Aronson ..... 44/42

2,163,009 6/1939 Pratt ..... 44/42

3,775,198 11/1973 Hijikata ..... 44/42 X 4,200,437 4/1980 Cox ..... 44/42

FOREIGN PATENT DOCUMENTS 1375371 9/1964 France ..... 44/42

*Primary Examiner*—Carl F. Dees

*Attorney, Agent, or Firm*—Fidelman, Wolffe & Waldron

[57] ABSTRACT

A match having a scent compound released upon burning is described, in which the igniting tip end of the matchstick is coated with a first layer consisting of an adsorbent, a scent compound and/or a deodorant and a binder and, onto this first layer, with a second layer consisting of igniting composition.

9 Claims, 1 Drawing Figure

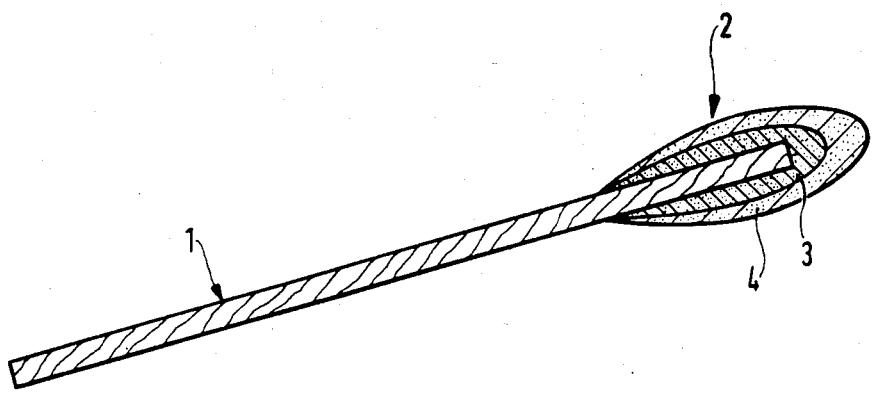
2
1
3
4

MATCH

The invention relates to a match having a scent compound released upon burning.

A match of this type is known. The aim is to release scent compound upon burning the match and thereby to modify organoleptically unpleasant odour compounds in the air, ie. to act on them so that the disturbing odour is no longer perceived. In the case of the known scented match, a section at the igniting tip end of the matchstick is impregnated with scent compounds. However, as practice has shown, upon burning the match only part of the scent compound is released, which then burns in the direct vicinity of the flame and thus is no longer effective. Added to this is the fact that, when such scented matchsticks are stored for prolonged periods, the pores in the wood of the matchstick cause the scent compound to be diffused as through a wick in the stick and gradually to be released therefrom and escape prematurely. As a result, the match can become completely ineffective on use.

The object of the invention is to create a match of the type stated at the start which achieves the desired effect with just small amounts of a scent compound and/or deodorant even after long storage time.

This object is achieved by means of a match of the type stated at the start in that the igniting tip end of the matchstick is coated with a first layer consisting of an adsorbent, a scent compound and/or deodorant and a binder and, onto this layer, with a second layer consisting of igniting composition.

An expedient development of the match is characterised in the subclaims.

In the case of such a match, the igniting composition burns and the heat thereby produced spreads over the entire layer underneath containing the air improver of scent compound and/or deodorant. This layer is heated up and the air improver still contained therein in full concentration is released and diffuses in the room. The cavities and the surface of the adsorbent are filled and wetted, respectively, completely or partially with scent compound and/or deodorant, which is retained in the first layer by the adsorbent and the binder. An absorption of the preferably liquid scent compound and/or deodorant embedded in the adsorbent by the wood of the matchstick can therefore not take place. The igniting composition of the second layer covers the first layer and also prevents a premature escape of scent compound and/or deodorant. In this way, the scent compound is practically conserved in the match and its effect can fully develop upon burning the match.

The drawing diagrammatically illustrates a match with applied layers.

The igniting tip end 2 of the matchstick 1 is coated with a first layer 3 containing scent compound and/or deodorant and, onto the latter, with a second layer 4 containing the igniting composition.

The layers are applied successively by the dipping method.

The compound of the first layer 3 consists of an adsorbent, for example kieselguhr, silica gel and/or active carbon.

Other known substances can also be used however. It is present in the compound in the form of individual particles and/or as a conglomerate and the scent compound, preferably in liquid form, is mixed in. A plastic dispersed in water, for example a cold glue, preferably vinyl acetate, is added. It serves as a binder and forms a protective layer for the air improver consisting of scent compound and/or deodorants and acts as an adhesive between the first layer 3 and the wood of the matchstick 1. In this way, a microencapsulation is achieved, which prevents scent compound and/or deodorant escaping prematurely from the adsorbent or being absorbed by the porous, absorbent wood of the matchstick. Instead of a wood stick, a wax stick can also be used for the match. The adsorbent in any case forms a scent compound store, and offers assurance of full effectiveness.

In a preferred embodiment, added to the first layer 3 is a metal powder, for example aluminium powder up to a particle size of 100 μm, which is likewise surrounded by the binder. Such a metal powder causes the heat transfer in the layers to be improved and thereby has a favourable effect on the subsequent evaporation of the scent compound and/or deodorant.

Binders of an aqueous cold glue dispersion, preferably vinyl acetate, offer not only a good coating of the individual particles without incipient dissolution of scent compounds consisting of ethereal oils, but also the advantage that they are waterproof after drying on. Furthermore, such a binder is relatively diffusion-tight. It is not rapidly broken down upon thermal heating. When heated, the surrounding layers form, seen microscopically, fine hairline cracks, through which the entrapped and now evaporating scent compounds or deodorants can escape without any problem.

After the first layer 3 is dry, the second layer 4, containing the igniting composition, is applied likewise by the dipping method, it being expedient if the entire surface of the first layer 3 is convered. An igniting composition known per se can be used. However, it can be made waterproof by the addition of a waterproof or moisture-insensitive binder. This means that the match does not become unusable even when kept in a slightly damp room.

It is expedient if the length of the layers 3 and 4 on the igniting tip end 2 of the matchstick 1 is a multiple of the diameter of the matchstick.

The first layer 3 as scent compound carrier can, for example, be composed as follows:

| | |
|---|---|
| 15% | kieselguhr, calcined |
| 11% | 75% (or 60 to 140% depending on absorbtivity), scent compound, |
| 8% | aluminium powder |
| 17% | binder (vinyl acetate), dry, |
| 1% | bentonite or Aerosil, dry, |
| 48% | water |
| 100% | |

Slightly divergent compositions are also possible.

The advantages of a scented matchstick compared with the known aerosols for air improvement consist in that no propellant is used, a better metering of the scent or the deodorant is ensured and the substance for air improvement evaporates and is not released in aerosol form.

I claim:

1. A match comprising a match splint with a match head formed thereon, said head comprising:

an outer second layer of igniting composition to provide heat to an inner first layer upon ignition of said outer second layer; and said inner first layer comprising an adsorbent with a scent compound therein, and a binder means for encapsulating said adsorbent with scent compound, said binder means having a property of gradual breakdown in order to gradually release a scent of said scent compound from said first layer only upon being heated by ignition of said outer second layer.

2. A match according to claim 1, characterised in that the second layer completely covers a surface of the first layer.

3. A match according to claim 1, characterised in that the adsorbent of the first layer is present in the form of particles coated by the binder.

4. A match according to claim 1 characterised in that the adsorbent is at least one of kieselguhr, silica gel and active carbon.

5. A match according to claim 1, characterised in that the binder is a plastic dispersible in water.

6. A match according to claim 1, characterised in that the scent compound is embedded in the adsorbent in liquid form.

7. A match according to claim 1, characterised in that the first layer contains a metal powder in order to improve heat transfer thereto.

8. A match according to claim 7, characterised in that the metal powder is aluminium having a particle size of up to 100 $\mu$m.

9. A match according to claim 1, characterised in that the second layer is moisture-insensitive.

* * * * *